US006539186B2

(12) United States Patent
Kitazawa et al.

(10) Patent No.: US 6,539,186 B2
(45) **Date of Patent: *Mar. 25, 2003**

(54) IMAGE FORMING APPARATUS HAVING A CLEANING DEVICE

(75) Inventors: Atsunori Kitazawa, Nagano (JP); Hidetsugu Shimura, Nagano (JP); Yujiro Nomura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/993,758

(22) Filed: Nov. 27, 2001

(65) Prior Publication Data

US 2002/0076234 A1 Jun. 20, 2002

Related U.S. Application Data

(62) Division of application No. 09/612,243, filed on Jul. 7, 2000, now Pat. No. 6,334,034.

(30) Foreign Application Priority Data

| | | |
|---|---|---|
| Jul. 21, 1999 | (JP) | 11-206047 |
| Jul. 9, 1999 | (JP) | 11-195951 |
| Jul. 9, 1999 | (JP) | 11-195955 |
| Jul. 9, 1999 | (JP) | 11-195956 |

(51) Int. Cl.[7] ..... G03G 15/02
(52) U.S. Cl. ..... 399/100; 399/174; 399/176
(58) Field of Search ..... 399/100, 115, 399/174–176; 361/225

(56) References Cited

U.S. PATENT DOCUMENTS

| | | | | |
|---|---|---|---|---|
| 4,788,573 A | | 11/1988 | Nakaoka et al. | |
| 5,557,373 A | | 9/1996 | Miyashita et al. | |
| 5,638,158 A | | 6/1997 | Sanpe et al. | 399/100 X |
| 5,697,020 A | | 12/1997 | Sato et al. | 399/100 |
| 5,873,019 A | | 2/1999 | Mizuishi | 399/176 X |
| 5,978,616 A | | 11/1999 | Shin | 399/100 X |
| 6,022,660 A | | 2/2000 | Uno | 430/110 |
| 6,029,029 A | | 2/2000 | Danzuka | 399/100 |
| 6,173,142 B1 | | 1/2001 | Kawakami | 399/175 |
| 6,334,034 B1 | * | 12/2001 | Kitazawa et al. | 399/100 |

FOREIGN PATENT DOCUMENTS

| | | |
|---|---|---|
| EP | 0 567 023 A2 | 10/1993 |
| JP | 58-194061 | 11/1983 |
| JP | 63-149668 | 6/1988 |
| JP | 6-342237 | 12/1994 |
| JP | 7-110618 | 4/1995 |
| JP | 7-128954 | 5/1995 |
| JP | 7-128956 | 5/1995 |
| JP | 7-168422 | 7/1995 |
| JP | 7-111591 | 11/1995 |
| JP | 2853208 | 11/1998 |

* cited by examiner

*Primary Examiner*—William J. Royer
(74) *Attorney, Agent, or Firm*—Sughrue Mion, PLLC

(57) ABSTRACT

An OPC 2, a charger 9, a cleaner 10 for cleaning the charger 9, a holder 11 for holding the charger 9, a support frame 12 for supporting the holder 11, a pair of springs 13 and 14 and a driver 15 for driving the holder are accommodated in a single process cartridge 8. The cleaner 10 can be brought into contact with the charger 9 and separated from the same. The driver 15 moves the cleaner 10 between a position of contact at which the cleaner 10 is brought into contact with the charger 9 and a position of separation at which the cleaner 10 is separated from the charger 9. The charger 9 has a wettability that is lower than that of a photosensitive member on which an electrostatic latent image is formed.

6 Claims, 8 Drawing Sheets

IMAGE FORMING APPARATUS HAVING A CLEANING DEVICE

This is a divisional of application Ser. No. 09/612,243 filed Jul. 7, 2000; now U.S. Pat. No. 6,334,034 the disclosure of which is incorporated herein by reference.

BACKGROUND OF THE INVENTION

The present invention relates to an image forming apparatus arranged to bring a charger, such as a charging roller, into contact with a photosensitive member to charge the photosensitive member and form an electrostatic latent image on the charged photosensitive member so as to form an image. More particularly, the present invention relates to an image forming apparatus incorporating a cleaner for cleaning a charger and arranged to remove foreign matter, such as toner, allowed to adhere to the charger.

An image forming apparatus, such as an electrostatic copying machine and a printer, incorporates a charging unit for charging a photosensitive member. Hitherto, corona charge has widely been adopted to the charging unit. The corona charge, however, suffers from a problem of a defect of a formed image because ozone or nitrogen oxide is formed which adheres to the surface of the photosensitive member or the like.

Therefore, a charger apparatus adapted to a contact charging method has been disclosed in, for example, Japanese Patent Publication No. 63-49668A. The foregoing method is arranged to bring a charger to which voltage is applied and which is constituted by, for example, urethane rubber into contact with the photosensitive member so as to charge the photosensitive member. The foregoing contact charging method is able to overcome the problem experienced with the foregoing corona charge.

The contact charging method is arranged such that the charger is in contact with the photosensitive member. Therefore, the contact charging method encounters adhesion of foreign matter to the surface of the charger, the foreign matter being, for example, toner on the photosensitive member, undesirably allowed to pass through the cleaning unit or toner separated from the developing unit. Therefore, defective charge of the photosensitive member occurs, causing the quality of the formed image to deteriorate.

Therefore, pieces of image forming apparatus of a type incorporating a cleaner for removing foreign matter, such as toner, allowed to adhere to the surface of the charger have been suggested. When the cleaner of the image forming apparatus is always in contact with the charger, the surface of the charger sustains damage. In the foregoing case, defective charging occurs. Therefore, the cleaner is disposed such that contact and separation with respect to the charger are permitted. The cleaner is brought into contact with the charger only when the charger is cleaned. When the charger is not cleaned, the cleaner is separated from the charger. Usually, the charger is periodically cleaned when a printing operation is not performed. For example, in Japanese Patent Publication No. 7-128954A, the charger is cleaned whenever a predetermined number of image forming operations has been performed. In Japanese Patent Publication No. 7-128956A, the charger is cleaned at intervals of predetermined time.

A variety of pieces of image forming apparatus have been suggested in, for example, Japanese Patent No. 2853208. The foregoing image forming apparatus has a structure that the photosensitive member, the development unit and the cleaning unit are accommodated in a single process cartridge. The process cartridge is detachably mounted on a predetermined position in the body of the image forming apparatus. When the photosensitive member or the like deteriorates, the process cartridge is changed.

The related image forming apparatus incorporating the member for cleaning the charger and arranged to use a detachable process cartridge has a structure that the cleaner is provided for the body of the image forming apparatus without exception.

When the cleaner is provided for the body of the image forming apparatus, (1) since the cleaner is provided for the purpose of removing foreign matter, such as toner, allowed to adhere to the charger, cleaning conditions including the contact load at which the cleaner is brought into contact with the charger and the position of contact must be optimized. Since the cleaner is provided for the body of the image forming apparatus, optimization of the cleaning conditions cannot easily be performed because cleaning conditions are undesirably varied. As a result, the life of the charger is shortened undesirably. When the contact load is too large, the surface of the charger sustains damage. When the contact load is too small, the performance for removing foreign matter, such as toner, deteriorates.

(2) Since the cleaning unit must be changed individually from change of the process cartridge, a user must bear a heavy load, such as labor for changing the cleaning unit.

Besides, when foreign matter, such as toner, adheres to the charger, the foregoing deterioration in the image does not occur. That is, the density of the output image is sometimes changed. In the foregoing case, the charger is not cleaned with the cleaner. That is, the density of the image is adjusted to correct the change in the density of the image. The correction is realized by patch control (charging bias or a development bias is adjusted in the foregoing case).

The patch control is, as disclosed in, for example, Japanese Patent Publication No. 7-111591B, performed to correct change in the density of an image in a case where the density of the image is changed according to change in the use environment and length of the operation time.

When change in the density of an image occurring when foreign matter, such as toner, adheres to the charger is corrected by the foregoing patch control, an operation for cleaning the charger which is performed after the patch control has been performed sometimes results in change in the density of the image in spite of completion of the adjustment of the density of the image by performing the patch control.

Besides, a cleaning unit incorporating a mechanism for permitting contact/separation of the cleaner and arranged to clean the charger has a structure that toner removed from the charger by the cleaner is accumulated in a nip portion in which the charger and the cleaner are in contact with each other when the cleaner is separated from the charger. A portion of toner is moved to the photosensitive member. Therefore, when the operation of the photosensitive member is interrupted at arbitrary timing, removed toner is sometimes left on the photosensitive member. When the image forming apparatus has started a printing operation in the foregoing state, movement of toner removed and left on the photosensitive member to the transferring position undesirably causes toner to be transferred. Thus, there arises a problem in that an image defect occurs.

Therefore, when the cleaner periodically cleans the charger, occurrence of an image defect caused from transference of toner removed and left on the photosensitive member must be prevented.

In general, an electrophotographic method is arranged to bring a rubber blade into contact with a photosensitive member under a predetermined pressure so as to remove residual toner on the photosensitive member after an image has been transferred therefrom. Abrasion between the photosensitive member and the rubber blade causes the leading end of the blade to repeat small mechanical vibration during the operation. In cases where the vibrations are amplified, a defect state of cleaning occurs momentarily. Thus, residual toner is sometimes leaked downstream of the blade. Thus, toner adheres to the charging roller, causing contamination to occur.

Hitherto, the contamination of the charging roller has been prevented by the following suggested methods.

(1) a method with which a cleaner is pressed against the charging roller to mechanically remove contamination (for example, Japanese Patent Publication No. 6-342237A); and a method with which a cleaner is vibrated in the axial direction of a charging roller to improve cleaning efficiency (for example, Japanese Patent Publication No. 7-110618A);

(2) a method with which toner allowed to adhere to the charging roller is uniformed to prevent occurrence of line-shape contamination which causes a problem image (for example, Japanese Patent Publication No. 7-168422A).

Since the charging roller is constituted by resin, rubber or the like, the foregoing method (1) with which contamination is mechanically removed requires a structure that a pad, rubber, sponge or the like is employed as the cleaner to remove contamination. Therefore, it is very difficult to remove toner allowed to adhere the surface of the charging roller. Although toner can be removed when the cleaner is strongly pressed against the charging roller, the surface of the roller easily sustains damage. When the cleaner is pressed with a low pressure to prevent damage of the surface of the roller, toner is undesirably left in the form of lines on the surface of the charging roller. Therefore, the contact pressure between the cleaner and the charging roller cannot easily be adjusted.

The foregoing method (2) with which adhesive toner is uniformed is a method of removing toner. As the apparatus is used, contamination is gradually accumulated. Thus, the charging roller is covered with toner. Therefore, a radical countermeasure against contamination cannot be realized.

SUMMARY OF THE INVENTION

In view of the foregoing, the first object of the present invention is to provide an image forming apparatus capable of reliably and easily optimizing cleaning conditions and reducing the load which must be borne by a user when the changing operation or the like is performed.

The second object of the present invention is to provide an image forming apparatus capable of preventing exertion of an influence of the operation of the cleaner in a case where the patch control is performed.

The third object of the present invention is to provide an image forming apparatus arranged to prevent transference of toner in a case where toner removed by a cleaner is left on the photosensitive member so as to prevent an image defect caused from removed toner.

The fourth object of the present invention is to prevent contamination of the charger so as to form an image having high quality.

In order to achieve the above objects, according to the present invention, there is provided an image forming apparatus comprising:

a photosensitive member on which an electrostatic latent image is to be formed;

a rotative charger brought into contact with the photosensitive member to charge the same;

a cleaner brought into contact with the charger to clean the same;

a cleaner driver for bringing the cleaner into contact with the charger and for separating therefrom; and a single cartridge detachably provided in the image forming apparatus for accommodating the photosensitive member, the charger, the cleaner and the cleaner driver.

Since the photosensitive member, the charger, the cleaner and the cleaner driver are accommodated in a single process cartridge, the position accuracy between the charger and the cleaner can considerably be stabilized. Hence it follows that the cleaner can reliably and substantially uniformly be brought into contact with the charger. It leads to a fact that the cleaning conditions under which the cleaner cleans the charger can furthermore reliably and easily be optimized.

Since the cleaner driver and the cleaner are accommodated in the same process cartridge, any mechanical connection between the cleaner driver and the cleaner is not required when the cleaner is accommodated in the process cartridge as compared with a structure that the cleaner driver is provided in the body of the image forming apparatus. Therefore, only electrical connection with the power source in the body of the image forming apparatus is required. Hence it follows that the cleaning conditions can be made to be stable and facilitated in spite of the operation of the cleaner which is brought into contact with the charger and separated from the same. As a result, foreign matter, such as toner, allowed to adhere to the surface of the charger can furthermore reliably be removed. Since only the electrical connection is required, the structure between the cleaner driver and the cleaner can be simplified. It leads to a fact that the cost can be reduced.

Since the foreign matter on the surface of the charger can furthermore reliably be removed, the life of the process cartridge accommodating the cleaner and the cleaner driver can be elongated.

Since the cleaner, the cleaner driver, the photosensitive member and the charger are accommodated in a single process cartridge, the accommodated units can substantially and easily be replaced. Thus, a user's load can be reduced.

Preferably, the cleaner driver brings the cleaner into contact with the charger to execute the cleaning operation at least immediately before a patch control for adjusting the density of image to be formed is performed.

Accordingly, foreign matter, such as toner, has been removed from the surface of the charger when the patch control is performed. In the foregoing case, the density of the image is adjusted by the patch control. Then the charger is not cleaned. Hence it follows that stable and satisfactory image quality can be maintained until a cleaning operation which is performed immediately before the next patch control.

Preferably, the photosensitive member is provided as a photosensitive drum. The photosensitive drum is rotated after the cleaner which has terminated the cleaning operation has been separated from the charger, and continues rotating until a portion of the photosensitive member, which corresponds to the portion from which the cleaner has separated, passes a position where a developed image thereon is to be transferred onto an image transfer member.

In this case, even if some of toner removed by the cleaner has been moved to the surface of the photosensitive member, toner present on the photosensitive member can reliably pass through the image transfer position. Therefore, when the image forming apparatus performs an image forming operation after the cleaner has completed the operation for cleaning the charger, the toner is not transferred. Thus, occurrence of an image defect can be prevented.

Alternatively, the photosensitive drum is rotated at least one time alter the cleaner, which has terminated the cleaning operation, has been separated from the charger.

In this case, even if some of toner removed by the cleaner has been moved to the surface of the photosensitive member, toner present on the photosensitive member can reliably be removed by the cleaning unit. Thus, when the image forming apparatus performs an image forming operation after the cleaner has completed the operation for cleaning the charger, transference of the toner can be prevented. As a result, occurrence of an image defect can reliably be prevented.

Preferably, the cleaner is brought into contact with the charger with a contact pressure which is enough to float residual toner adhered onto the charger, and not enough to allow the floated toner to pass through to a downstream portion of the cleaner.

Preferably, wettability of the charger with respect to toner used for developing the latent image is lower than that of the photosensitive member.

In this case, the toner allowed to adhere to the charger is floated to reduce the intermolecular force of the toner with respect to the charger to allow passing of the toner to the downstream position. Because the wettability of the photosensitive member with respect to the toner is made to be larger than that of the charger with respect to the toner, the toner which is allowed to move to the downstream position of the charger is moved to the photosensitive member. Therefore, contamination of the charger can effectively be removed.

Preferably, the wettability of the charger is larger than that of the cleaner.

In this case, adhesion of the toner to the cleaner does not easily occur. Thus, passing of the toner from the cleaner can efficiently be performed. As a result, contamination of the charger can effectively be reduced.

Preferably, the cleaner is provided as a brush member having a predetermined contact width in the rotational direction of the charger.

In this case, since the cleaner can uniformly be brought into contact with the charger without any gap, toner having reduced intermolecular force can frequently be produced. Since scraped toner can be accumulated in the fibers of the brush member, contamination of the peripheral portion can be reduced. Moreover, the accumulated toner is not permanently trapped in the fibers. That is, the toner can be discharged to the downstream position.

Preferably, the contact pressure of the cleaner is within a range from 0.1 g/cm to 30 g/cm.

Preferably, the cleaner has conductivity.

In this case, an abnormal discharge phenomenon caused from accumulation of electric charge can be prevented. Thus, contamination of the peripheral portion with toner caused from the abnormal discharge can be prevented.

Preferably, hardness of the surface of the charger is represented as 2H or higher of the pencil hardness.

In this case, frequency of piercing of the fluidizer can be reduced. Therefore, contamination of the charger can be prevented. As a result, the cleaning efficiency can be improved.

Preferably, the cleaner is separable from the charger.

In this case, since the cleaner is not always in contact with the charger, damage of the charger is not sustained by the cleaner. Therefore, fatigue of the cleaner can be prevented.

Preferably, a potential of the charger is made floatable when the cleaner is brought into contact with the charger.

In this case, electrostatic adhesivity of toner to the charger and that to the photosensitive member can be made to be the same. Therefore, toner can efficiently be moved to the photosensitive member.

Preferably, the cleaner is moved in an axial direction of the charger while the charger is rotated.

In this case, even toner allowed to adhere to the charger with large intermolecular force can be floated because the intermolecular force can be reduced more effectively.

Preferably, the cleaner is provided as a brush member leading ends of which are engaged with the charger. The distance for which the cleaner is moved is longer than the engagement depth of the cleaner.

In this case, the leading ends of the brush member can be moved and slid with respect to the charger. The large intermolecular force with which the toner is allowed to adhere can be reduced.

Preferably, the distance for which the cleaner is moved is longer than a contact width between the charger and the photosensitive member.

In this case, uniformity of charging caused by the charger can be improved.

DETAILED DESCRIPTION OF THE PREFERRED EMBODIMENTS

Figure 1:
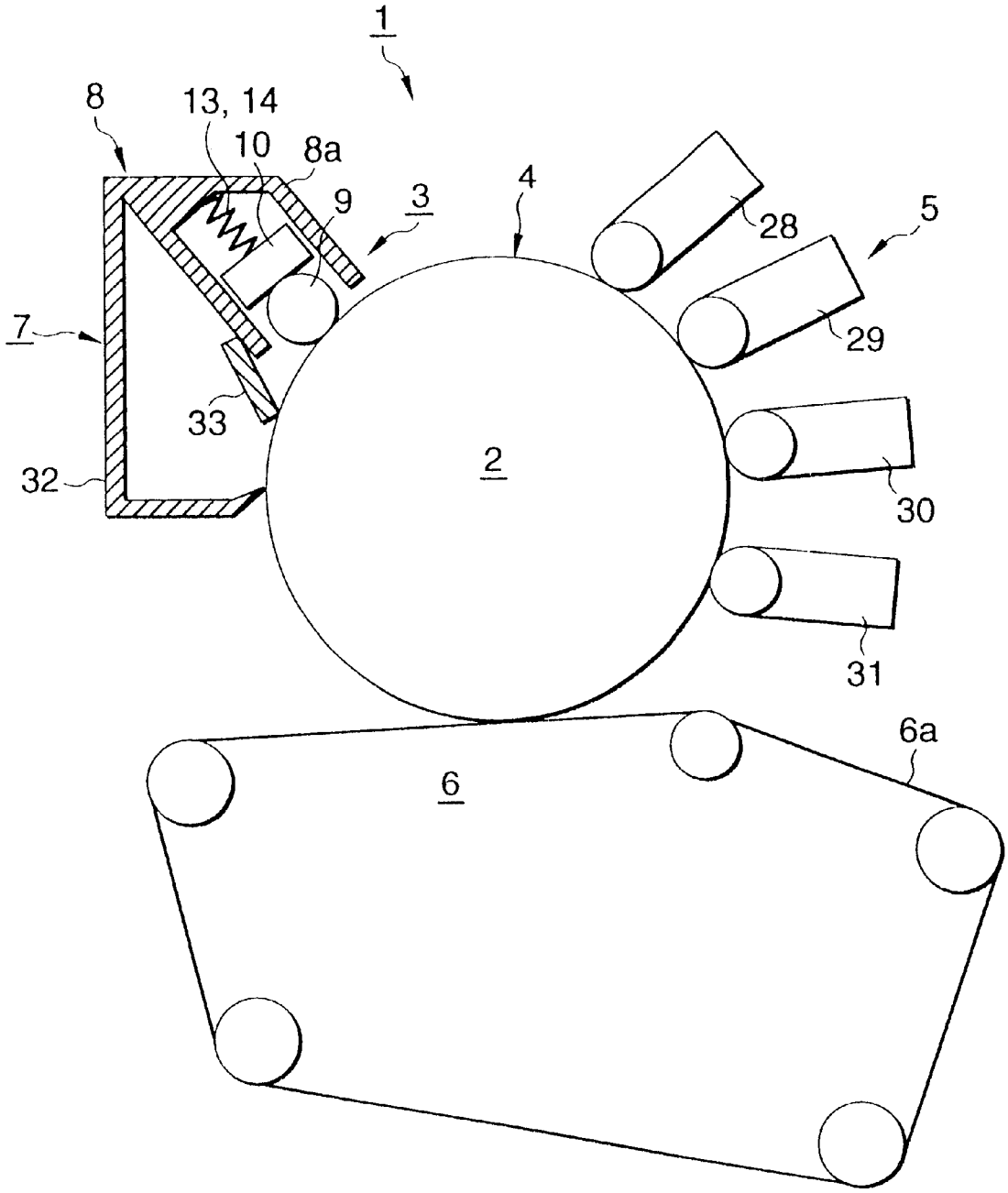
FIG. 1 is a diagram schematically showing an intermediate transfer type full-color image forming apparatus according to one embodiment of the present invention.

Referring to the drawings, one embodiment of the present invention will now be described.

FIG. 1 is a diagram schematically showing an intermediate transfer type full-color image forming apparatus according to one embodiment of the present invention.

As shown in FIG. 1, an image forming apparatus 1 according to this embodiment incorporates a photosensitive member (hereinafter also called an "OPC") 2, a charging unit 3, an exposure unit 4, a development unit 5, an intermediate transfer unit 6 and a cleaning unit 7. Moreover, the image forming apparatus 1 incorporates a transferring unit (not shown) for transferring an intermediate transferred image to a transfer belt 6*a* of the intermediate transfer unit 6 to a transfer member, such as transfer paper; and a fixing unit for fixing the image transferred to the transfer member.

Similarly to a related image forming apparatus, the charging unit 3, the exposure unit 4, the development unit 5, the intermediate transfer unit 6 and the cleaning unit 7 are sequentially disposed adjacent to the OPC 2 in a clockwise direction when the units are viewed in the drawing. The OPC 2, the charging unit 3, the development unit 5 and the cleaning unit 7 are accommodated in a single process cartridge 8 (FIG. 1 schematically shows the process cartridge 8).

Figure 2:
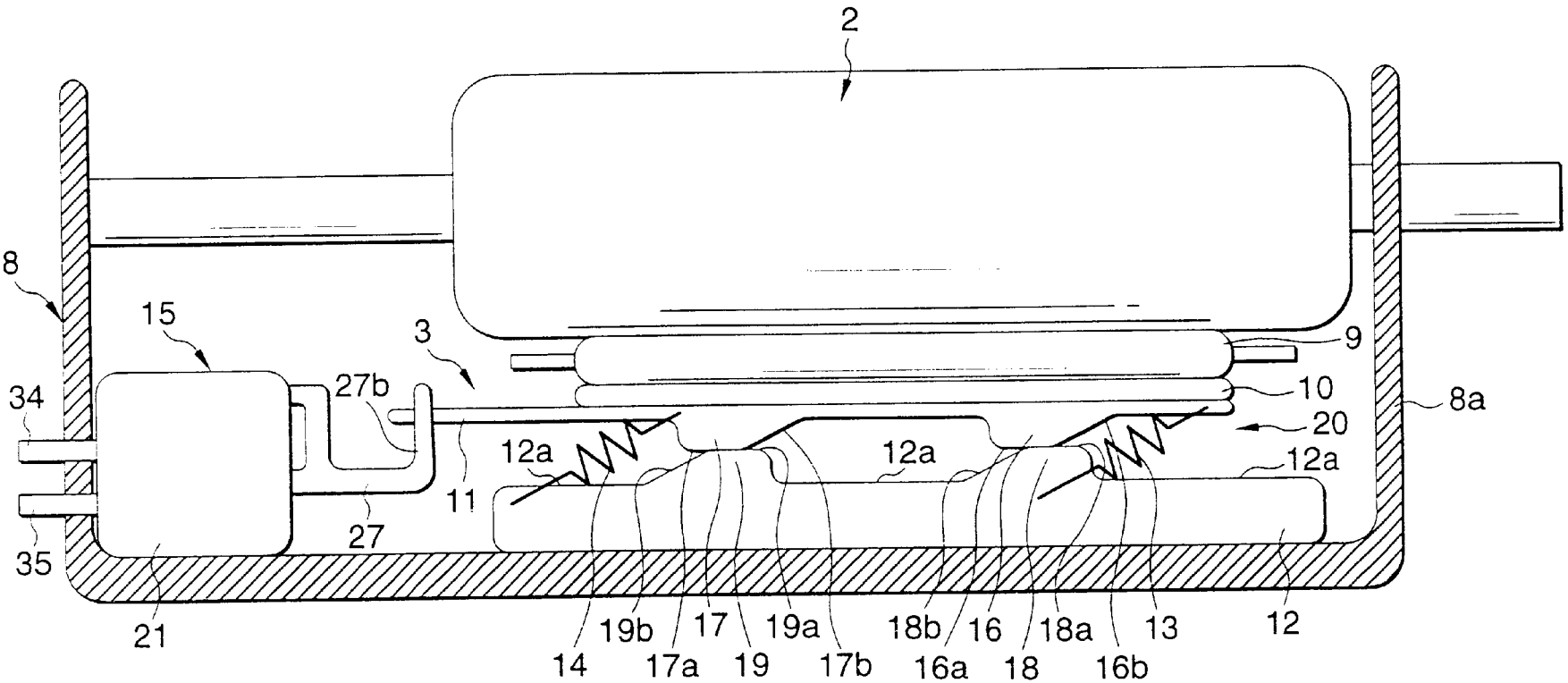
FIG. 2 is a diagram showing a photosensitive member, a charger, a cleaner and a driver accommodated in a process cartridge provided in the image forming apparatus of FIG. 1 in a state where the cleaner has been brought into contact with the charger.

As shown in FIG. 2 in detail, the image forming apparatus 1 incorporates the OPC 2 accommodated in the process cartridge 8 such that the OPC 2 is rotatively supported by a frame 8*a* of the process cartridge 8. Also the charging unit 3 is accommodated in the process cartridge 8. The charging unit 3 incorporates a charger 9, such as a charging roller, rotatively supported by the frame 8*a* so as to be brought into contact with the OPC 2 and charge the OPC 2; a cleaner 10 for cleaning the surface of the charger 9; a holder 11 disposed such that vertical and lateral movements are permitted when the holder 11 is viewed in the drawing so as to hold the cleaner 10; a support frame 12 for supporting the holder 11 secured to the process-cartridge frame 8*a*; a pair of springs 13 and 14 disposed apart from each other at positions between the holder 11 and the support frame 12 and contracted in the lengthwise direction of the holder 11 so as to always urge the charger 9 in a direction in which the cleaner 10 is separated from the charger 9 through the holder 11; and a driver 15 for driving the holder 11 to bring the cleaner 10 into contact with the charger 9 or separate the same from the charger 9.

A pair of projections 16 and 17 project over the lower face of the holder 11 disposed opposite to the support frame 12. The projections 16 and 17 are disposed apart from each other for a predetermined distance in the lengthwise direction of the holder 11 such that the projections 16 and 17 face the support frame 12. The projections 16 and 17 have lower faces 16*a* and 17*a* formed into flat faces. Moreover, right-hand side faces 16*b* and 17*b* of the projections 16 and 17 are formed into faces gently slanted to the left at the same angle of inclination when the projections 16 and 17 are viewed in the drawing. Also a pair of projections 18 and 19 project over the upper face of the support frame 12 disposed opposite to the holder 11. The projections 18 and 19 are disposed apart from each other for the distance which is the same as the distance for which the pair of the projections 16 and 17 are disposed apart from each other such that the projections 18 and 19 face the holder 11. The projections 18 and 19 have the same cross sectional shapes as those of the projections 16 and 17 in the lengthwise direction such that the right and left directions of the cross sections are opposite to each other. Therefore, the upper faces 18*a* and 19*a* of the projections 18 and 19 are formed into flat faces. Moreover, the left-hand side faces 18*b* and 19*b* are gently slanted to the left at an angle of inclination which is the same as the angle of inclination of the right-hand side faces 16*b* and 17*b* when the left-hand side faces 18*b* and 19*b* are viewed in the drawing. Also the pair of the springs 13 and 14 are slanted similarly to the inclination of the right-hand side faces 16*b* and 17*b* and the left-hand side faces 18*b* and 19*b*. The pair of the springs 13 and 14 are contracted between the holder 11 and the support frame 12.

Figure 3:
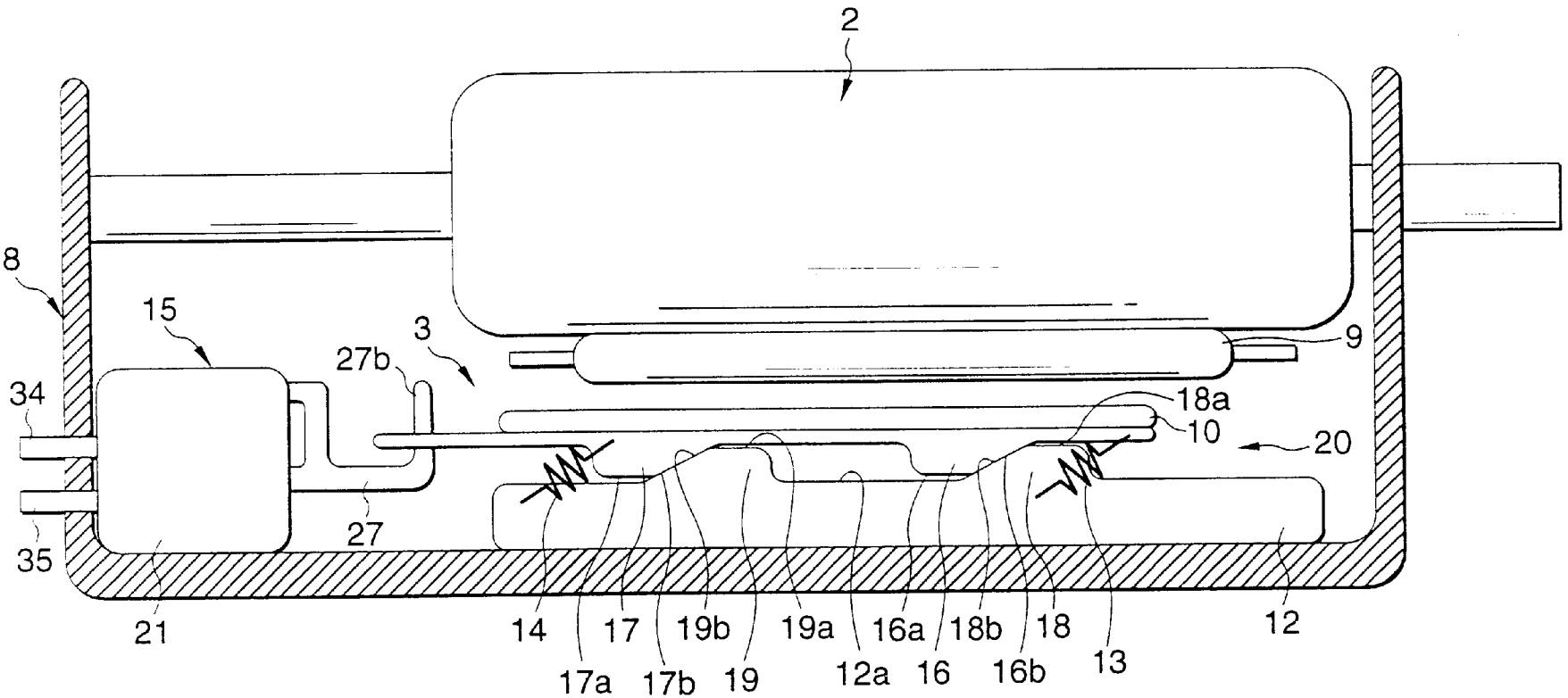
FIG. 3 is a diagram showing the photosensitive member, the charger, the cleaner and the driver accommodated in the process cartridge provided in the image forming apparatus of FIG. 1 in a state where the cleaner has been separated from the charger.

The holder 11 is able to move within a region from a contact position at which the cleaner 10 is brought into contact with the charger 9 as shown in FIG. 2 and a separation position at which the cleaner 10 is separated from the charger 9 as shown in FIG. 3. At the contact position, a state is realized in which the lower faces 16*a* and 17*a* of the projections 16 and 17 of the holder 11 are placed on the upper faces 18*a* and 19*a* of the projections 18 and 19 of the support frame 12. Moreover, the holder 11 is stably supported by the support frame 12. As a result, the holder 11 is able to stably and reliably bring the cleaner 10 into contact with the charger 9. At the separation position, both of the right-hand side faces 16*b* and 17*b* of the projections 16 and 17 of the holder 11 are placed on the slanted faces of the left-hand side faces 18*b* and 19*b* of the projections 18 and 19 of the support frame 12. Thus, the holder 11 can substantially stably be supported by the support frame 12. Note that the lower faces 16*a* and 17*a* of the projections 16 and 17 of the holder 11 may be supported by the upper face of a floor face 12*a* of the support frame 12 in a state where the right-hand side faces 16*b* and 17*b* are made to be in contact with the left-hand side faces 18*b* and 19*b*.

The holder 11, the support frame 12 and the springs 13 and 14 constitute a cleaner driver 20 for bringing the cleaner 10 into contact with the charger 9 and separating the cleaner 10 from the same.

The image forming apparatus according to this embodiment incorporates the pair of the springs 13 and 14, the pair of the projections 16 and 17 and the pair of the projections 18 and 19. The number of the foregoing elements may be an arbitrary number. In the foregoing case, it is preferable that the pressure is as nearly uniformly applied from the cleaner 10 to the charger 9 in the axial direction of the charger 9. Although both of the projections 16 and 17 of the holder 11 and the projections 18 and 19 of the support frame 12 have the slanted faces, the slanted face may be provided for only either of the holder 11 or the support frame 12.

Figure 4:
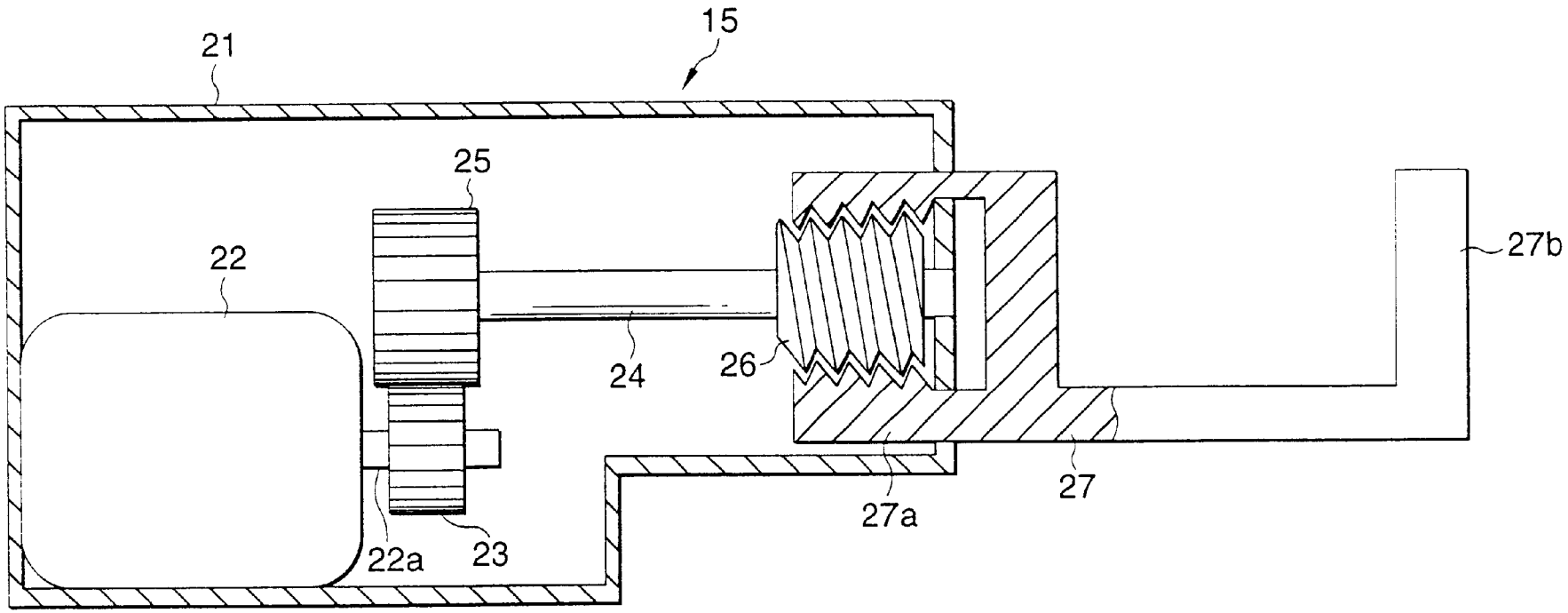
FIG. 4 is a diagram showing the driver for the cleaner provided in the image forming apparatus of FIG. 1.

As shown in FIG. 4, the driver 15 for driving the holder 11 incorporates a housing 21 which is secured to the process-cartridge frame 8*a*; a motor 22 accommodated in the housing 21; a first gear 23 joined to a rotational shaft 22*a* of the motor 22; a rotating-force transmitting shaft 24 rotatively disposed in the housing 21; a second gear 25 disposed at the left-hand end of the rotating-force transmitting shaft 24 when the rotating-force transmitting shaft 24 is viewed in the drawing so as to be engaged to the first gear 23 and having a diameter larger than that of the first gear 23; a male-thread portion 26 disposed opposite to the second gear 25 of the rotating-force transmitting shaft 24; and a connection member 27 incorporating a female-thread portion 27*a* disposed to penetrate the housing 21 such that rotation is inhibited and movement in the axial direction is permitted and engaged to the male-thread portion 26 such that the left-hand end of the holder 11 is connected to the connection portion 27*b*. The connection portion 27*b* of the connection member 27 and the left-hand end of the holder 11 have known connecting structures (not shown) such that relative movement in only the vertical direction is permitted when they are viewed in the drawing. Note that the male-thread portion 26 may be provided to correspond to the connection member 27 and the female-thread portion 27*a* may be provided to correspond to the rotating-force transmitting shaft 24.

In the illustrated state, the connection member 27 is brought to the most forward position from the housing 21. At the forward position of the connection member 27, the holder 11 and the cleaner 10 are disposed at the contact positions, as shown in FIG. 2. When the motor 22 is rotated in a direction in which the connection member 27 is retracted, the rotations of the motor 22 are reduced by the first and second gears 23 and 25 before the rotations are transmitted to the male-thread portion 26. Thus, the male-thread portion 26 is rotated, causing the connection member 27 to be retracted into the housing 21. Since the connection member 27 is retracted, the holder 11 is moved to the left. Thus, the lower faces 16*a* and 17*a* of the projections 16 and 17 of the holder 11 are separated from the upper faces 18*a* and 19*a* of the projections 18 and 19 of the support frame 12. It leads to a fact that the holder 11 is, by the spring force of the pair of the springs 13 and 14, pulled downwards, that is, toward the support frame 12. At this time, the holder 11 is moved to the left in the downward direction while the slanted faces of the right-hand side faces 16*b* and 17*b* of the projections 16 and 17 are being brought into contact with the slanted faces of the left-hand side faces 18*b* and 19*b* of the projections 18 and 19 so as to be guided. Hence it follows that the cleaner 10 is moved with respect to the charger 9 in the axial direction as well as in the diagonally downward direction. Thus, the cleaner 10 is moved away from the charger 9. After the connection member 27 has been retracted for a predetermined distance, the rotation of the motor 22 is stopped. Thus, the connection member 27 is positioned at the position of retraction. When the connection member 27 is positioned at the position of retraction, the holder 11 and the cleaner 10 are positioned at distant positions shown in FIG. 3.

To move the connection member 27 from the retraction position to the forward position, the motor 22 is inversely rotated to froward move the connection member 27 from the housing 21. Moreover, the holder 11 is moved to the right. At this time, the holder 11 is upward moved to the right while the slanted faces of the right-hand side faces 16*b* and 17*b* of the projections 16 and 17 are being guided by the slanted faces of the left-hand side faces 18*b* and 19*b* of the projections 18 and 19. After the connection member 27 been moved forward to the maximum extent, the rotation of the motor 22 is stopped. Hence it follows that the connection member 27 is moved to the forward position shown in FIG 2. When the connection member 27 is positioned at the forward position, the holder 11 and the cleaner 10 are positioned at the contact positions shown in FIG. 2.

Figure 5:
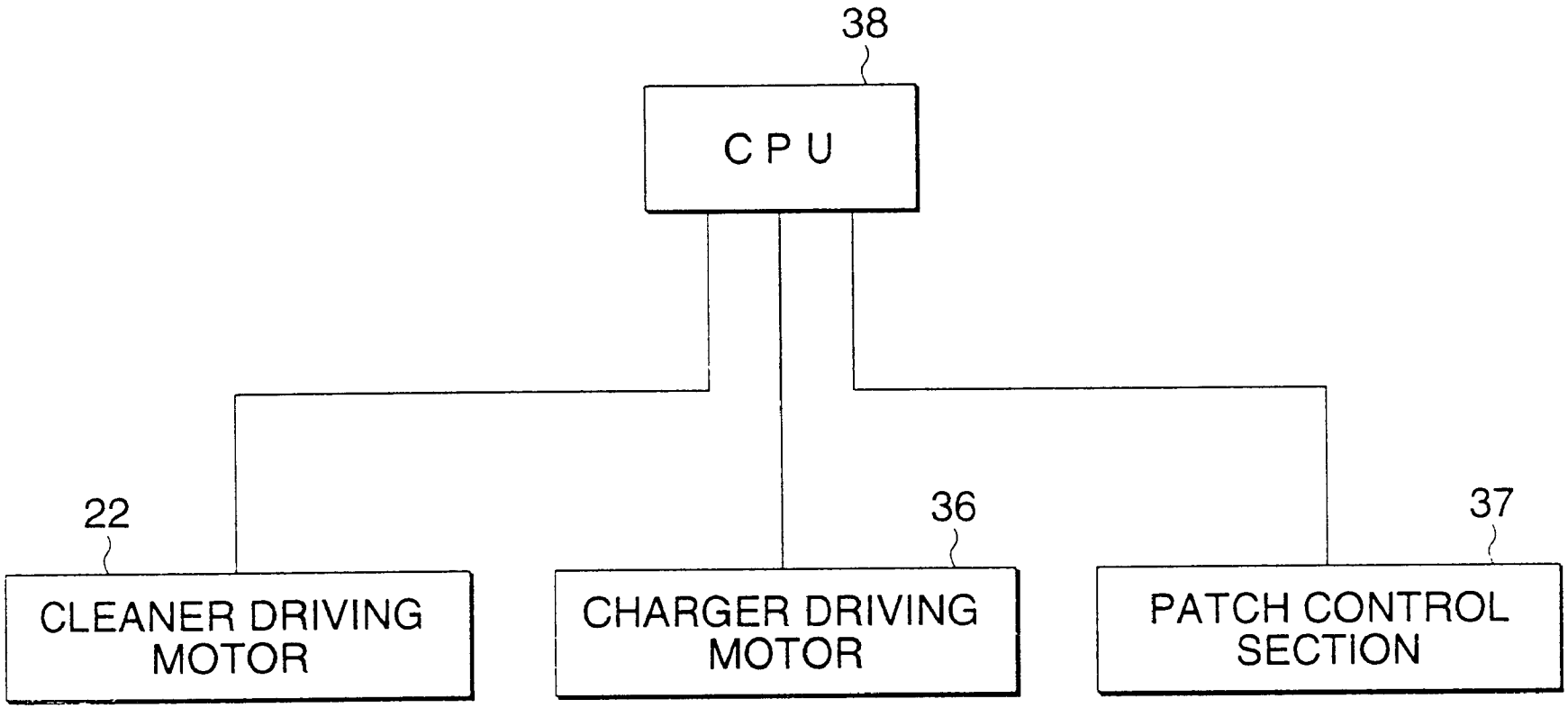
FIG. 5 is a control block diagram showing a cleaning operation of the cleaner provided in the image forming apparatus of FIG. 1.

The method of controlling the operation of the cleaner 10 for cleaning the charger 9 will now be described. FIG. 5 is a block diagram for controlling the cleaning operation of the cleaner 10.

As shown in FIG. 5, the image forming apparatus 1 according to this embodiment has a structure that both of the motor 22 capable of realizing contact and separation of the cleaner 10 and a motor 36 for operating the charger 9 are connected to a central processing unit (hereinafter called a "CPU") 38. The CPU 38 operates a patch control section 37 to perform the patch control for adjusting the density of an image similarly to the related method.

In a usual state, the CPU 38 stops the rotation of the motor 22 such that the cleaner 10 is positioned at the distant position as shown in FIG. 3. When the charging operation is not performed, the CPU 38 stops the motor 36. The charger 9 is cleaned when the charging unit 3 does not perform the charging operation.

When the charger 9 is cleaned in a state where both of the motors 22 and 36 are stopped, the CPU 38 rotates the motor 22 to move the cleaner 10 to the contact position. Then, the CPU 38 stops the rotation of the motor 22. Therefore, the charger 9 is stopped when the cleaner 10 is brought into contact with the charger 9. Then, the CPU 38 rotates the motor 36 to rotate the charger 9. Thus, the cleaner 10 cleans the charger 9. After the motor 36 has been rotated for a predetermined time and thus the charger 9 has been cleaned, the CPU 38 stops the rotation of the motor 36. Then, the CPU 38 rotates the motor 22 in an inverse direction to separate the cleaner 10 from the charger 9. Then, the CPU 38 moves the cleaner 10 to the distant position. Then, the rotation of the motor 22 is stopped. Thus, the operation for cleaning the charger 9 is completed.

When the charger 9 is cleaned after the patch control has been performed to adjust the density of the image, the density of the image is sometimes undesirably changed in spite of completion of the density adjustment. Therefore, the image forming apparatus 1 according to this embodiment is arranged such that the CPU 38 brings the cleaner 10 into contact with the charger 9 immediately before the patch control section 37 performs the patch control so that the charger 9 is cleaned by the cleaner 10.

Accordingly, when the patch control is performed, contamination caused from foreign matter, such as toner, has been removed from the surface of the charger 9. As a result, the patch control is performed to adjust the density of the image in the foregoing state without any influence of the operation for cleaning the charger 9. Therefore, stable and satisfactory image quality can be maintained until a cleaning operation is performed immediately before next patch control is performed.

The image forming apparatus 1 may be arranged such that when the CPU 38 stops the rotation of the motor 36 and rotates the motor 22 in the inverse direction to separate the cleaner 10 from the charger 9, the CPU 38 simultaneously rotates the motor 36 to rotate the OPC 2. The rotation of the OPC 2 is continued after the cleaner 10 has been separated from the charger 9 until the portion of the OPC 2 corresponding to the portion from which the cleaner 10 has been separated passes the transferring position.

As described above, the CPU 38 controls the rotations of the motors 22 and 36 to cause the contact or separation of the cleaner 10 to be performed in a state where the charger 9 is stopped when the cleaner 10 is brought into contact with the charger 9 or moved away from the same. Moreover, the CPU 38 controls the rotation of the motor 37 from a moment at which the cleaner 10 has been separated from the charger 9 until the portion of the OPC 2 corresponding to the portion from which the cleaner 10 has been separated passes the transferring position.

Accordingly, when some of the toner removed by the cleaner 10 is moved to the surface of the OPC 2, toner on the OPC 2 passes through the transferring position so as to be moved to the cleaning unit 7. Therefore, when the image forming apparatus 1 performs an image forming operation after the charger 9 has been cleaned with the cleaner 10, toner is not transferred. As a result, an image defect can be prevented.

Even if the charger 9 is periodically cleaned with the cleaner 10, a necessity for considering the image defect whenever the cleaning operation is performed can be eliminated.

The image forming apparatus 1 may be configured such that the OPC 2 is rotated one or more times after the cleaner 10 has been separated from the charger 9.

Since the OPC 2 is rotated one or more times after the cleaner 10 has been separated from the charger 9, toner on the OPC 2 can rotatively be removed by the cleaning unit 7 when some of the toner removed by the cleaner 10 has been moved to the surface of the OPC 2. Therefore, when the image forming apparatus 1 performs an image forming operation after the charger 9 has been cleared with the cleaner 10, transference of toner can furthermore reliably be prevented. As a result, an image defect can be prevented.

Similarly to the development unit of a related full-color image forming apparatus, the development unit 5 incorporates yellow, magenta, cyan and black development units 28, 29, 30 and 31. The development units 28, 29, 30 and 31 are disposed around the OPC. The disposing order of the development units 28, 29, 30 and 31 is not limited to the foregoing order. That is, the order may arbitrarily be determined. In the following description, an assumption is made that the development units 28, 29, 30 and 31 are disposed in the foregoing order, that is, the order as yellow, magenta, cyan and black for convenience in description.

Similarly to the related full-color image forming apparatus, the cleaning unit 7 incorporates a cleaner housing 32 and a cleaning blade 33. In the foregoing case, the cleaner housing 32 is formed integrally with the frame 8*a* of the process cartridge 8 as shown in the drawing. Another structure may be employed in which the cleaner housing 32 is individually formed from the frame 8*a* so as to be joined to the frame 8*a*.

As described above, the image forming apparatus 1 according to this embodiment has the structure that the OPC 2, the charger 9, the cleaner 10 for cleaning the charger 9, a cleaner driver 20 for realizing contact and separation of the cleaner 10 with respect to the charger 9, the driver 15 for driving the cleaner driver 20, the development unit 5 and the cleaning unit 7 are accommodated in a single process cartridge 8 (although a fact that the development unit 5 and the cleaning unit 7 are accommodated in the process cartridge 8 is not illustrated, the foregoing elements are accommodated in the process cartridge 8 in a similar way to the related art).

Reference numerals 34 and 35 shown in FIGS. 2 and 3 represent conductive lines for electrically connecting the motor 22 to a power source of the image forming apparatus.

The operation of the image forming apparatus 1 structured as described above will now be described.

In a usual state, the cleaner 10 is positioned at the distant position shown in FIG. 3 so that the cleaner 10 is distant from the charger 9. When an image is formed, the face of the OPC 2 is charged by the charger 9 similarly to the related image forming apparatus. Then, the exposure unit 4 exposes the image to the charged portion on the OPC 2 as an electrostatic latent image. The electrostatic latent image on the OPC 2 is sequentially developed by the yellow, magenta, cyan and black development units 28, 29, 30 and 31 so as to be formed into a visible image. Then, the developed image on the OPC 2 is primarily-transferred to the intermediate transfer unit 6 so as to be supplied to the transferring position unit (not shown). Then, the transferring unit performs color matching so as to transfer the image to a transfer member. Then, the image is fixed by a fixing unit (not shown) so that a required image is obtained on the transfer member.

After the developed image has been transferred to the transfer member, toner left on the OPC 2 is removed by the cleaning blade 33 of the cleaning unit 7 so as to be accommodated in the cleaner housing 32. After the image has been formed by the image forming apparatus 1 and the OPC 2 has been destaticized, the OPC 2 is again charged by the charger 9 to form a next image. Then, similar image forming steps are performed.

Toner left on the OPC 2 after the transferring step has been completed is removed from the OPC 2 by the cleaning blade 33 so as to be accommodated in the cleaner housing 32. A portion of toner is not removed, and then allowed to pass through the cleaning blade 33 so as to be moved to the charger 9. Thus, toner adheres to the charger 9. Also toner separated from the development unit during the image forming process which is performed for a predetermined period of time sometimes adheres to the charger 9. Also a case occurs in which dust flying adjacent to the OPC 2 sometimes adheres to the charger 9. Therefore, the image forming apparatus 1 according to this embodiment is arranged to periodically perform the cleaning step. Thus, foreign matter allowed to adhere to the charger 9 is removed by the cleaner 10.

The cleaning step is performed such that the motor 22 is rotated for a predetermined angular degree so that the cleaner 10 is, as described above, moved to the contact position shown in FIG. 2 so as to be brought into contact with the charger 9. The charger 9 is rotated in the foregoing state so that foreign matter allowed to adhere to the charger 9 is removed by the cleaner 10. The foreign matter removed by the cleaner 10 is accommodated in the cleaner housing 32 in the process cartridge 8. As an alternative to this, the foreign matter is accommodated in an accommodating unit in a case where the accommodating unit is provided in the process cartridge 8 individually from the cleaner housing 32. After the charger 9 has been rotated for a predetermined time, the charger 9 is stopped. Then, the motor 22 is again rotated in the inverse direction so that the cleaner 10 is moved to the distant position shown in FIG. 3. Thus, the cleaner 10 is separated from the charger 9. Hence it follows that the cleaning step is completed.

When the photosensitive member 2 must be changed, the process cartridge 8 is removed from the body of the image forming apparatus. Then, a new process cartridge 8 is mounted on the body of the image forming apparatus. Since the cleaner 10 is also changed, a necessity for changing the cleaner 10 can be eliminated. In the foregoing case, the cleaner 10 must also be changed in a usual case. Therefore, simultaneous change of the cleaner 10 does not result in any waste.

As described above, the image forming apparatus 1 according to this embodiment has the structure that the OPC 2, the charger 9, the cleaner 10 for cleaning the charger 9, the cleaner driver 20 for bringing the cleaner 10 into contact with the charger 9 and separating the same from the cleaner 10 and the driver 15 for driving the cleaner driver 20 are accommodated in a single process cartridge 8. Therefore, the position accuracy between the charger 9 and the cleaner 10 can considerably satisfactorily be stabilized. Thus, the cleaner 10 can reliably and substantially uniformly be brought into contact with the charger 9. As a result, the charger 9 can furthermore reliably be cleaned by the cleaner 10. Since the position accuracy between the charger 9 and the cleaner 10 can be stabilized, considerable improvement in the position accuracy is not required. That is, the charger 9 and the cleaner 10 can easily be joined.

Since the driver 15 is accommodated in the process cartridge 8, the mechanical connection between the driver 15 and the cleaner 10 is not required when the cleaner 10 is accommodated in the process cartridge 8 as compared with the structure that the driver 15 is provided for the body of the image forming apparatus. Therefore, only electric connection with the power source of the body of the image forming apparatus is required. Hence it follows that the cleaning conditions can be stabilized and facilitated in spite of the structure that the cleaner 10 is brought into contact with the charger 9 and separated from the same. As a result, foreign matter, such as toner, allowed to adhere to the surface of the charger 9 can furthermore reliably be removed. Moreover, the structure between the driver 15 and the cleaner 10 can be simplified and, therefore, the cost can be reduced.

As described above, foreign matter on the surface of the charger 9 can furthermore reliably be removed. As a result, the life of the process cartridge 8 which accommodates the cleaner 10 and the driver 15 can be elongated.

It is a known fact that the OPC 2, the cleaner 10 and the like cannot be used permanently. That is, the foregoing units must be changed at arbitrary timing according to the state of use of the image forming apparatus 1. Since the cleaner 10, the OPC 2 and the charger 9 are accommodated in a single process cartridge 8, change of the foregoing units can simultaneously and easily be performed. As a result, a user's load can be reduced.

The image forming apparatus 1 according to this embodiment produces great axial force with which the driver 15 moves the holder 11 in the axial direction. When a mechanism for switching the rotation caused by the motor 22, the male-thread portion 26 and the female-thread portion 27*a* into a linear motion is employed, great axial force can be obtained. Therefore, when another driver, such as an electromagnetic solenoid, is employed, the size of the motor 22 can be reduced. As a result, space saving can effectively be realized.

The image forming apparatus 1 according to this embodiment has the structure that the OPC 2, the charger 9, the cleaner 10, the cleaner driver 20, the driver 15, the development unit 5 and the cleaning unit 7 are accommodated in a single process cartridge 8. The present invention is not limited to the foregoing structure. At least the OPC 2, the charger 9, the cleaner 10, the cleaner driver 20 and the driver 15 may be accommodated in a single process cartridge 8.

The image forming apparatus 1 according to this embodiment is structured such that the present invention is applied to the full-color image forming apparatus. Note that the present invention is not limited to the foregoing structure. When the image forming apparatus incorporates at least the photosensitive member, the charger for charging the photosensitive member, the cleaner for cleaning the charger and the process cartridge, the present invention may be applied to any apparatus.

Another embodiment of the present invention will now be described.

Figure 6:
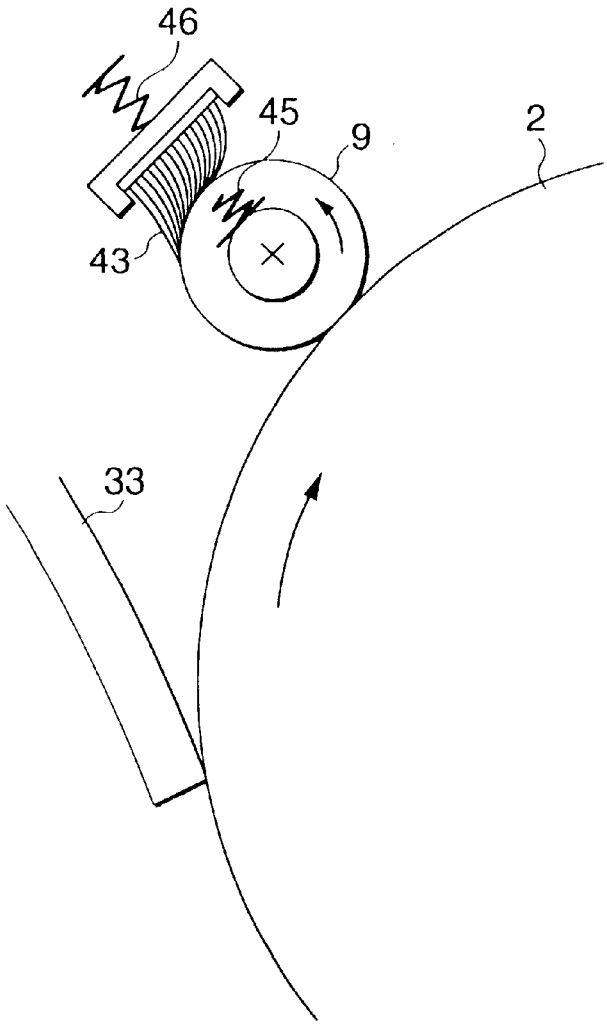
FIG. 6 is a diagram showing the schematic structure of an image forming apparatus according to another embodiment of the present invention.

FIG. 6 is a diagram showing the schematic structure of a portion of an image forming apparatus according to the present invention in the vicinity of a charging roller.

A charger (a charging roller) 9 is brought into contact with an image carrier (a photosensitive member) 2 with force exerted from a spring 45 for establishing contact of the charging roller 9. Thus, the charging roller 9 uniformly charges the surface of the photosensitive member 2 while the charging roller 9 rotates to follow the rotation of the photosensitive member 2. The photosensitive member 2 which has uniformly been charged is sequentially subjected to formation of an electrostatic latent image, formation of a toner image and transfer (transference to paper or an intermediate transfer belt) by an electrostatic latent image forming unit, a development unit and a transferring unit (not shown). Toner left on the surface of the photosensitive member 2 is scraped off by a cleaning blade 4. Then, the photosensitive member 2 is again charged to permit formation of an image.

Since the operation speed and the resolution of an image forming apparatus, such as a printer and a copying machine, have been raised and color development structure of the same has been employed, the particle size of toner has been reduced. Therefore, deterioration in the fluidity of toner must be prevented by excessively adding fluidizer (an inorganic substance). Therefore, the cleaning easiness of toner deteriorates, causing undesirable passing of toner form the blade to easily occur. In addition to toner, the coagulated fluidizer which has been separated from toner undesirably passes through the blade. The substance which has passed through the blade is pressed with the nipping pressure between the charging roller 9 and the photosensitive member 2. A portion of the substance adheres to the charging roller 9. A portion of the substance is returned to the photosensitive member 2 in accordance with the rotation of the charging roller. A major portion of the substance strongly adheres to the charging roller 9 due to repeated pressing in the nip portion (the contact portion) between the charging roller 9 and the photosensitive member 2. In particular, toner adheres to the charging roller such that the fluidizer which has pierced the charging roller and coagulated serves as cores. Toner is allowed to adhere to the charging roller 9 mainly owing to intermolecular force (Van der Waals force).

In this embodiment, the cleaner is provided as a toner floater 43 having a fibrous form or a brush-like consistency, which is brought into contact with the charging roller 9 by a spring 46 for establishing the contact of the toner floater 43. Thus, relative movement between the charging roller 9 and the toner floater 43 is used to float (or move) toner to reduce the intermolecular force of toner which is exerted on the charging roller 9. Then, toner is moved to the photosensitive member 2.

To reduce the intermolecular force of toner which is exerted on the charging roller, the toner floater 43 is brought into contact with the charging roller 9 with at least force with which toner allowed to strongly adheres to the charging roller is floated. That is, when the toner floater 43 is brought into contact with the charging roller 9 with a predetermined force and the charging roller is rotated, the toner floater 43 and toner conflict each other. As a result, kinetic energy is exerted on the toner so that the toner is floated (or moved). Since also movement of toner to the photosensitive member 2 is caused in the present invention, contact is established with force to such an extent that the toner floater does not scrape toner. Therefore, toner in a floated state passes from the toner floater 43 to a downstream position.

Figure 7:
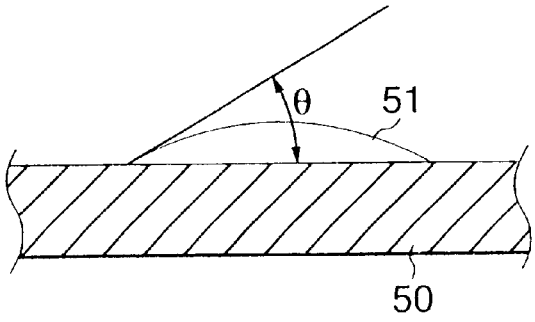
FIG. 7 is a diagram showing angles of contact.

To move toner allowed to pass through the toner floater 3 to the photosensitive member 2, the adhesion of the charging roller 9 and that of the photosensitive member 2 with respect to toner must have the relationship that the adhesion of the photosensitive member is made to be larger. Note that the adhesion between toner and the member is evaluated in accordance with the wettability. When the wettability is great, evaluation is made that the adhesion is great. The wettability evaluation is basically performed such that toner is dropped on a subject which must be measured to measure the angle of contact (the angle made between the tangent of the surface of dropped liquid 51 and the surface of the subject which must be measured at a position of contact with the subject 50 which must be measured as shown in FIG. 7). Since toner has high viscosity even after it has been melted, measurement of the angle of contact is not suitable for toner. Therefore, solvent which can be substituted for the toner is used to measure the angle of contact by using the solvent. The solvent is selected such that a variety of solvent candidates are dropped on the surface of block-shaped toner having a flat surface by pressing the toner into the pellet form. Solvent exhibiting greatest wettability (smallest angle of contact) is selected. The surface energy concern the wettability. Solvent of a type which makes a small angle of contact with the block-shaped toner has the surface energy similar to that of the toner, that is, wettability.

That is, the present invention is structured such that the toner floater 43 is brought into contact with the charging roller 9 with the force which is not smaller than the force with which toner allowed to adhere the charging roller 9 is separated and at a pressure at which toner passes form the toner floater 43 to a downstream position. Moreover, the wettability of the charging roller 9 with respect to toner is made to be smaller than the wettability of the photosensitive member 2 with respect to the toner. Thus, toner allowed to adhere to the charging roller 9 is separated, that is, the toner is not scraped off. Then, the toner is caused to pass to the downstream position. Since the adhesiveness force of the photosensitive member 2 with respect to the toner is larger than that of the charging roller 9, the toner is moved from the charging roller 9 to the photosensitive member 2. As a result, contamination of the charging roller 9 can be removed.

Moreover, the wettability of the charging roller 9 with respect to toner is made to be larger than that of the toner floater 43 with respect to toner. As a result, toner does not easily adheres to the toner floater 43. Thus, passing of toner from the toner floater 43 can efficiently be performed. As a result, contamination of the charging roller 9 can efficiently be removed.

Figure 8A:
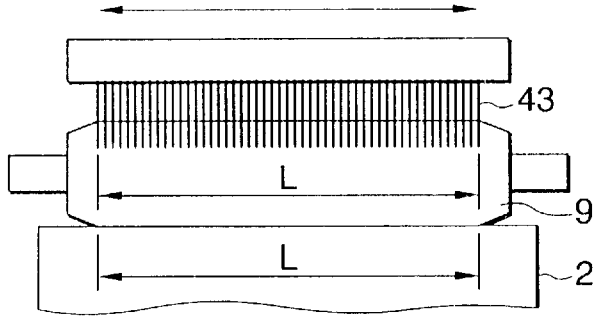
FIGS. 8A and 8B are side views showing a toner floater provided in the image forming apparatus of FIG. 6.
Figure 8B:
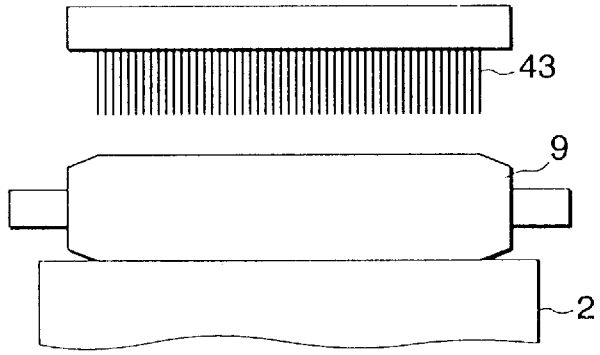
Figure 9A:
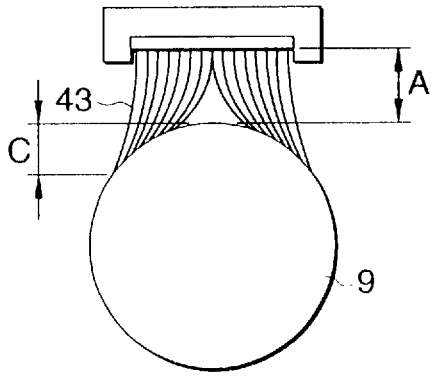
FIGS. 9A and 9B are cross sectional views showing the toner floater of FIGS. 8A and 8B.
Figure 9B:
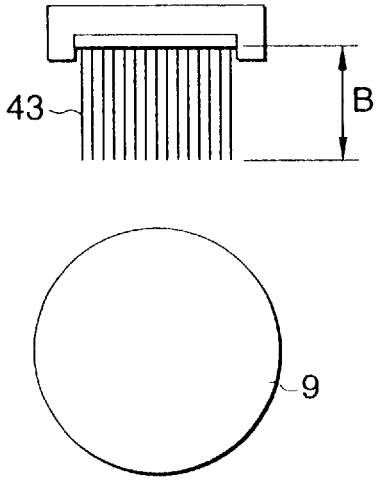

FIGS. 8A–8B and 9A–9B are side views and a cross sectional views showing an example of the toner floater according to the present invention. FIGS. 8A and 9A show a state of contact, while FIGS. 8B and 9B show a state of separation.

The toner floater 43 must be capable of floating toner allowed to adhere to the charging roller 9 and permit toner to pass to a downstream position. When the foregoing requirement is satisfied, any toner floater may be employed. FIGS. 8A and 8B show a structure constituted by a fibrous bundle and arranged to be brought into contact with the charging roller 9 with a certain width (=width of nipping) in the rotational direction. Since the toner floater 43 is formed into the fibrous shape, toner allowed to adhere to the charging roller 9 is brought into contact with the fibers of the toner floater 43. Thus, the position of the toner is shifted, causing a so-called uniforming effect to be obtained. Since the contact of the toner floater 43 is established with a certain width (the width of nipping), the fibers can furthermore uniformly be brought into contact with toner without any gap. Therefore, toner having the reduced intermolecular force can be produced at a high frequency.

The movable region for the toner floater 43 is made to be larger than the contact width L between the charging roller 9 and the photosensitive member 2 in the axial direction. A driver (not shown) moves (vibrates) the toner floater in the axial direction at least during the rotation of the charging roller. Since the toner floater 43 is moved as described above, the uniformity of charging realized by the charging roller 9 can be improved. When, for example, the end of the charging roller 9 is not cleaned, the amount of foreign matter which is deposited on the charging roller 9 is different between the cleaned region and the non-cleaned region. When the charging roller 9 and the photosensitive member 2 are brought into contact with each other in the foregoing state, the degree of nipping (the contact width between the charging roller 9 and the photosensitive member 2) in the cleaning region is reduced as the amount of foreign matter at the end portion is enlarged. As a result, a state of discharge of the charger 9 is changed, resulting in stability deteriorates when the degree of nipping is small.

As described above, the toner floater 43 is brought into contact with the charging roller 9 with the force with which toner allowed to adhere to the charging roller 9 is floated. Since also an operation that toner is not scraped off and allowed to move to the downstream position is performed, it is preferable that the contact pressure (the linear pressure: a load per unit length of the toner floater 43) which permits the foregoing operation is about 0.1 g/cm to 30 g/cm. Since the toner floater 43 is formed into the fibrous shape, scraped toner can be accumulated in the fibers in a case where the contact load is relatively high, for example, a level with which toner is scraped off. Therefore, contamination of the peripheral portion can be prevented. Moreover, accumulated toner is separated without any permanent trap in the fibers. Therefore, toner can be discharged to a downstream position from the toner floater 43.

It is preferable that the toner floater 43 has conductivity. When the toner floater 43 has conductivity, accumulation of electric charges in the toner floater 43 can be prevented which occurs owing to frictional charge caused from contact between the toner floater 43 and the charging roller 9 or the like. As a result, occurrence of an abnormal discharge phenomenon can be prevented. Thus, a necessity for preventing contamination of the peripheral portion with toner caused from abnormal discharge can be eliminated.

The pencil hardness of the surface layer of the charging roller 9 is made to be 2H or higher. Thus, frequency of piercing of the fluidizer (an inorganic substance) which serves as cores of the adhesion of toner to the charging roller 9 can be reduced. As a result, contamination of the charging roller 9 can be prevented, causing the cleaning efficiency to be improved.

As shown in FIGS. 8A–8B and 9A–9B, the toner floater 43 can be brought into contact with the charging roller 9 and separated from the same. Therefore, the toner floater 43 is not always in contact with the charging roller 9. As a result, any damage of the charging roller 9 is not sustained by the toner floater 43. Also the toner floater 43 is free form any fatigue, the stability of contact can be maintained.

As described above, the toner floater 43 is moved (or vibrated) in the axial direction of the charging roller 9 at least during the rotation of the charging roller 9. As a result, the large intermolecular force with which toner is allowed to adhere to the charging roller 9 can be reduced. Thus, toner can be floated. The distance for which the toner floater 43 is moved will now be described. As shown in FIG. 9, an assumption is made that the length of each fiber of the toner floater 43 is B, the distance from the root portion of the fiber realized when the contact has been realized is A and the engagement depth C of the toner floater 43 in the charging roller 9. Thus, engagement depth C is expressed as follows:

$$C=B-A$$

Figure 10:
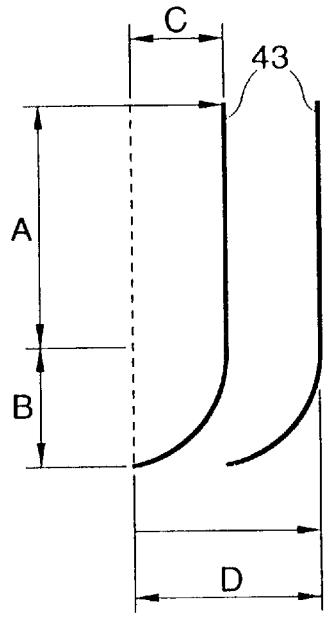
FIG. 10 is a diagram showing the distance for which the cleaner is moved in the axial direction of the charging roller.

An assumption is made as shown in FIG. 10 that movement of the toner floater 43 from the position indicated with a dashed line for the engagement depth C causes a portion (portion A) which is not in contact with the charging roller 9 to be moved in parallel. In a case where the leading end of the toner floater 43 is caught by the charging roller 9, the foregoing portion is not moved. When the toner floater 43 is moved for a distance longer than C, for example, distance D, also the leading end is pulled and moved. As described above, the distance for which the charging roller 9 is moved in the axial direction is made to be longer than the depth of engagement. Thus, the leading end of the other floater 43 can be moved and slid with respect to the charging roller 9. Even in a case where toner adheres to the charging roller 9 with large intermolecular force, the intermolecular force can be reduced. When the toner floater 43 has the fibrous form, a satisfactory effect can be obtained.

A specific example about wettability will now be described.

The cleaning performance of the charging roller according to the degree of wettability of the charging roller and that of the photosensitive member with respect to toner was evaluated under the following conditions.

(1) Color printing of 1000 sheets (=1 k sheets) was contiguously performed. During the printing operation, the toner floater was separated from the charging roller.

Figure 11:
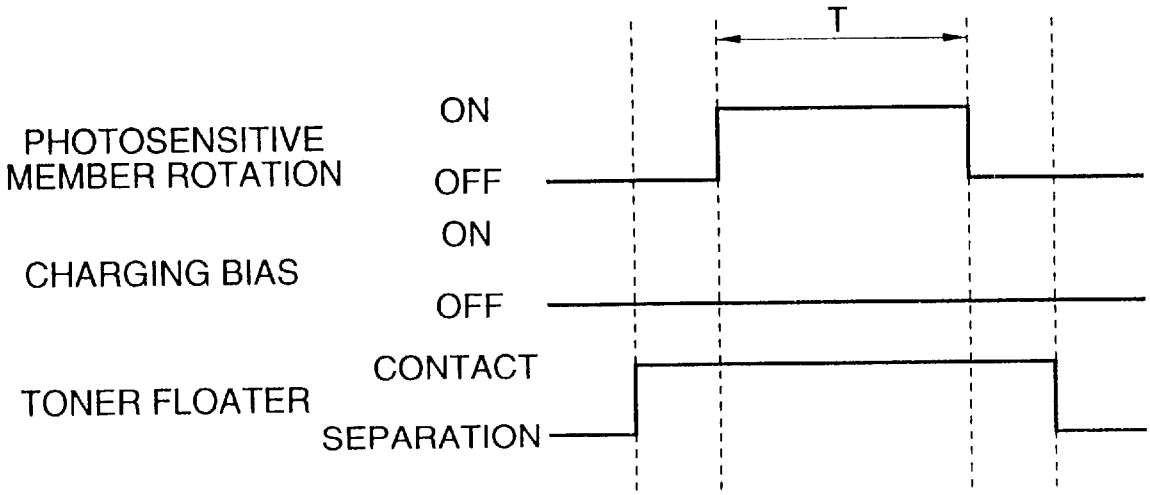
FIG. 11 is a diagram showing a sequence of cleaning operation for the charger.

(2) Then, a sequence shown in FIG. 11 was performed, that is, the charging bias was turned off. Then, the toner floater was made to be in contact with the charging roller during a period T in which the photosensitive member is rotated one time so that the charging roller was cleaned.

(3) Flows of toner realized during the cleaning operation was observed. Moreover, cleanness of the cleaned charging roller was visually observed.

(4) The process was returned to the process (1) so that the foregoing flow was repeated until color printing was performed to print 10 k sheets.

Obtained results are shown in Table 1. Table 1 also shows angles of contact of the member with ethanol.

TABLE 1

| photo- | cleaning operation | | cleaning performance | | contact angle | |
|---|---|---|---|---|---|---|
| sensitive member | after 1k | after 10k | after 1k | after 10k | charging roller | photosensitive member |
| 1 | A | A | A | A | 60° | 50° |
| 2 | B | B–C | B | C | 60° | 74° |

The charging roller was made of a mixed material of NBR rubber and epichlorohydrin rubber was formed on a shaft having a diameter of 10 mm to have a thickness of 1.5 mm. A mixed layer of urethane resin, fluorine-denatured urethane resin and tin oxide particles was formed on the rubber layer to have a thickness of 10 $\mu$m.

The photosensitive member 1 was formed by laminating an UCL (Under Clad Layer), a CGL (Charge Generating Layer) and a CTL (Charge Transporting Layer) on a substrate in order. The photosensitive members 1 and 2 are different from each other in the amount of fluorine substitution at the terminal group of binder resin (polycarbonate) of the CTL. The photosensitive member 2 had a larger amount of fluorine substitution.

The cleaning operation was evaluated as the amount of contamination transferred from the charging roller to the photosensitive member using the following criteria:

A: large amount of transfer

B: medium amount of transfer

C: no transfer

The cleaning performance was evaluated as the degree of cleanness of charging roller from which toner floater was separated using the following criteria:

A: clean

B: contamination observed

C: removal of contamination impossible

It is preferable that toner is dropped on a subject which must be measured to measure the angle of contact. However, toner having high viscosity even in a molten state is not suitable for the drop test. Therefore, solvent was employed as a substitute for toner to measure the angle of contact. The angle of contact was measured by CA-Z type FACE automatic contact-angle meter (manufactured by Kyowa Interface Science Co., Ltd.). The solvent was a material selected from cyclohexane, acetone, ethanol, ethylene glycol and water which exhibited highest affinity with toner (wettability). Specifically, toner was molded into cylindrical pellet having a thickness of 1 mm and a diameter of 10 mm. Then, the solvent was dropped on the pellet to measure the angle of contact. Then, the solvent having the smallest angle of contact was selected. As a result, ethanol was selected.

The comparisons of the angles of contact were made. As can be understood from Table 1, when the angle of contact of the charging roller is made to be larger than that of the photosensitive member, that is, when the wettability of the photosensitive member with respect to toner is made to be larger than that of the charging roller, contamination is moved from the charging roller to the photosensitive member when the charging roller is cleaned with the toner floater.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. An image forming apparatus, comprising:

a photosensitive member on which an electrostatic latent image is formed; and a rotative charger, which charges the photosensitive member, wherein a wettability of the charger with respect to toner used for developing the latent image is lower than that of the photosensitive member.

2. The image forming apparatus as set forth in claim 1, further comprising a cleaner, which cleans the charger, wherein the wettability of the charger is larger than that of the cleaner.

3. The image forming apparatus as set forth in claim 1, further comprising a cleaner, which cleans the charger, wherein the cleaner is provided as a brush member having a predetermined contact width in the rotational direction of the charger.

4. The image forming apparatus as set forth in claim 3, wherein a contact pressure of the cleaner is within a range from 0.1 g/cm to 30 g/cm.

5. The image forming apparatus as set forth in claim 1, further comprising a cleaner, which cleans the charger, wherein the cleaner is provided as a conductive member.

6. The image forming apparatus as set forth in claim 1, wherein a surface hardness of the charger is represented as 2H or higher defined by the pencil hardness.

* * * * *